United States Patent [19]

Tomikawa et al.

[11] Patent Number: 5,036,817

[45] Date of Patent: Aug. 6, 1991

[54] ENGINE REMOTE CONTROL SYSTEM

[75] Inventors: Osamu Tomikawa, Tsuchiura; Touichi Hirata, Ushiku; Akira Tatsumi, Kashiwa; Masakazu Haga; Masaki Egashira, both of Niihari; Hiroshi Watanabe, Ushiku, all of Japan

[73] Assignee: Hitachi Construction Machinery Co., Ltd., Tokyo, Japan

[21] Appl. No.: 460,072

[22] PCT Filed: Aug. 3, 1989

[86] PCT No.: PCT/JP89/00800

§ 371 Date: Jan. 30, 1990

§ 102(e) Date: Jan. 30, 1990

[87] PCT Pub. No.: WO90/01630

PCT Pub. Date: Feb. 22, 1990

[30] Foreign Application Priority Data

Aug. 5, 1988 [JP] Japan ..... 63-195858

[51] Int. Cl.[5] ..... F02D 11/10

[52] U.S. Cl. ..... 123/399; 123/400

[58] Field of Search ..... 123/399, 396, 395, 342, 123/400

[56] References Cited

U.S. PATENT DOCUMENTS

| | | | |
|---|---|---|---|
| 4,506,642 | 3/1985 | Pfalzgraf et al. | 123/399 |
| 4,622,936 | 11/1986 | Junginger et al. | 123/399 |
| 4,660,520 | 4/1987 | Inoue et al. | 123/399 |
| 4,928,647 | 5/1990 | Villanyi et al. | 123/400 |

FOREIGN PATENT DOCUMENTS

| | | | |
|---|---|---|---|
| 52-39289 | 3/1977 | Japan | 123/399 |

*Primary Examiner*—Andrew M. Dolinar

*Attorney, Agent, or Firm*—Antonelli, Terry, Stout & Kraus

[57] ABSTRACT

Disclosed is a remote control system which produces electric signals to be sent to a governor driving device from an operator's cabin for remote control of the governor mechanism. This remote control system essentially includes a detector for detecting the amount of control effected to the governor mechanism, and a control device which operates on detection signals from the detector and operation signals from an operating device in the operator's cabin. The control device is adapted to produce a stop signal to the driving device when the difference in control amount between two cyclic time points becomes smaller than a predetermined value, which is regarded as a limit of operation of the governor mechanism, thereby preventing impairment or damages of the governor mechanism and operating device.

3 Claims, 5 Drawing Sheets

Fig. 2

16

| | | |
|---|---|---|
| 16A | H | ACC. LIMIT FLAG |
| 16B | L | DEC. LIMIT FLAG |
| 16C | N | COUNTER |
| 16D | $E_N$ | CURRENT VOLTAGE |
| 16E | $E_{N-1}$ | PREVIOUS VOLTAGE |
| 16F | k | STOP CALL VOLTAGE |
| 16G | j | STOP CALL VOLTAGE |
| 16H | $E_H$ | ACC. LIMIT VOLTAGE |
| 16I | $E_L$ | DEC. LIMIT VOLTAGE |
| 16J | $t_o$ | HYSTERESIS TIME |

ENGINE REMOTE CONTROL SYSTEM

FIELD OF THE ART

This invention relates to an engine remote control system particularly suitable, for example, for remote control of a governor mechanism of Diesel engine on a construction machine.

BACKGROUND OF THE ART

Construction machines such as hydraulic cranes, power shovels and the like generally have a Diesel engine mounted thereon as a power source for rotationally driving a hydraulic pump or pumps.

Heretofore, it has been the conventional practice to provide an engine control lever in the driver's cabin of a construction machine, connecting the engine control lever to an engine governor mechanism through a control cable, link rod or the like for engine control. However, such a control cable or link rod which mechanically connects the control lever to the governor mechanism involves a great deal of mechanical resistance which will require a large operating force in addition to a problem of low response characteristics.

In an attempt to improve these drawbacks, there has been proposed a system for electrically remote-controlling the engine governor mechanism (Japanese Laid-Open Utility Model Application 61-145849), the remote control system being provided with: a governor adjusting driving device including an electric motor and located in the vicinity of the engine; an adjustment sensor for detecting the extent of actually effected adjustment in terms of the rotational angle of the electric motor output shaft of the driving device; an operating device provided in the operator's cabin and adapted to produce a command signal commensurate with the extent of manipulation of an operation switch or other operating means; and a control device like a microcomputer adapted to control the rotation of the electric motor of the drive means on the basis of the detection signal from the adjustment sensor and the command signal from the operating device in such a manner as to zeroize the difference between the two signals.

With this arrangement, the control lever of the governor mechanism is turned to an extent corresponding to the extent of manipulation of the operating means through feedback control of the driving device, which zeroizes the difference between the above-mentioned detection and command signals.

However, the above-mentioned engine remote control system, which is arranged to turn the control lever of the governor mechanism into a tilted position by controlling the rotation of the electric motor of the driving device, needs to provide means for preventing impairment or breakage of the electric motor or control lever which might result from overrunning rotation of the electric motor.

Therefore, for the purpose of delimiting the rotational angle (operating range) of the electric motor, the prior art systems are usually provided with a couple of limit switches and a cam member on the output shaft of the electric motor.

Naturally, the system construction including such limit switches and a cam member requires an increased number of component parts, and accurate preadjustments of operating points of the respective component parts, which are very troublesome.

Further, for the feedback control of the electric motor, the prior art system is arranged to compare the command signal from the operating device with the detection signal from the adjustment sensor which detects the rotational angle of the electric motor, so that there arises a necessity for preadjustments to bring the output range of the command signals from the operating device into conformity with the detection range of the adjustment detector, making the operations for adjustments of actual variations extremely difficult.

The present invention contemplates to eliminate the above-mentioned drawbacks of the prior art system, and has as its object the provision of an engine remote control system which is adapted to actuate and deactuate a driving device in relation with variations in the degree of tilting of the governor mechanism which is checked up in each program cycle, obviating the use of limit switches and a cam which have been conventionally resorted to for detection of the limits of the rotational angle of the driving device and unnecessitating the interrelating preadjustments of the operating and detecting devices.

DISCLOSURE OF THE INVENTION

In order to achieve the above-mentioned objectives, the engine remote control system of the invention includes: an engine having a governor mechanism for controlling the output rotation of the engine according to a specified control amount; a driving device for driving the engine governor mechanism; a detector for discerning the extent of control effected to the governor mechanism by the driving device; an operating device for producing an operation signal for controlling the output rotation of the engine; and a control device for producing a drive signal or a stop signal to the driving device on the basis of the operation signal from the operating device and the detection signal from the detector, the control device being adapted to read in the detection signal cyclically at predetermined time intervals, and compare the extent of effected control in a current cycle of surveillance with the extent of effected control in a preceding cycle to produce a stop signal to the driving device when the difference between the two cycles becomes smaller than a predetermined value, otherwise producing a drive signal based on the operation signal.

With this arrangement, the tilted condition of the governor mechanism is checked by way of the detection signal from the detector at predetermined time intervals determined by a program cycle, while the degree of effected control in a cycle of surveillance is compared with the degree of effected control in a preceding cycle to check if the governor mechanism has reached a limit of its operation. It follows that the driving device can be stopped as soon as the governor mechanism reaches its operation limit to prevent damages which might otherwise be caused to the governor mechanism and driving device.

According to an aspect of the present invention, the control device includes: a first drive control means adapted to read in the detection signal cyclically at predetermined time intervals, and compare the extent of effected control in a given cycle of surveillance with the degree of effected control in a preceding cycle, producing a stop signal to the driving device when the difference between the two cycles becomes smaller than a predetermined value regarded as a limit of operation of the governor mechanism, otherwise producing a drive signal based on the operation signal from the operating device; a memory means with a function of learning and storing as a control limit the degree of effected control at a time point when an operation limit of the governor mechanism is discriminated by the first drive control means; and a second drive control means adapted to compare the control limit stored in the memory means with a detected degree of control from the sensor in the cycles succeeding the discrimination of the control limit of the governor mechanism and to produce a stop signal to the driving device when the difference is smaller than a predetermined value regarded as a limit of operation of the governor mechanism, otherwise producing a drive signal based on the operation signal.

With this arrangement, when the governor mechanism is judged by the first drive control means as having reached a limit of its operation, the maximum or minimum degree of control at that time point is learned and stored by the memory means. Thereafter, the driving device can be stopped on the basis of the control limit stored in the memory and the detected degree of control from the detector, permitting high precision control even against variations in characteristics of the respective devices over an extended time period.

If desired, a protection device may be provided between the driving device and governor mechanism for permitting free action of the driving device when the driving force to be applied to the governor mechanism exceeds a certain predetermined level.

The provision of such a protection device contributes to stabilize the operation control even in the event when operation errors occur to the driving device.

BRIEF DESCRIPTION OF THE DRAWINGS

In the accompanying drawings:

FIGS. 1 to 3 show an embodiment of the invention, of which,

FIG. 1 is a schematic illustration of the layout of an engine remote control system according to the invention;

FIG. 2 is a diagrammatic illustration of the construction of a memory area provided in the control device; and FIG. 3 is a flow chart of processing steps executed by the control device for the control of the driving device;

FIGS. 5 and 6 show still another embodiment of the invention, of which, FIG. 5 is a schematic illustration of the layout of an engine remote control system in a third embodiment; and FIG. 6 is a schematic outer view showing on an enlarged scale a protection device shown in FIG. 5.

BEST MODE FOR PRACTICING THE INVENTION

Hereafter, the invention is described more particularly by way of the preferred embodiments shown in the accompanying drawings.

Figure 1:
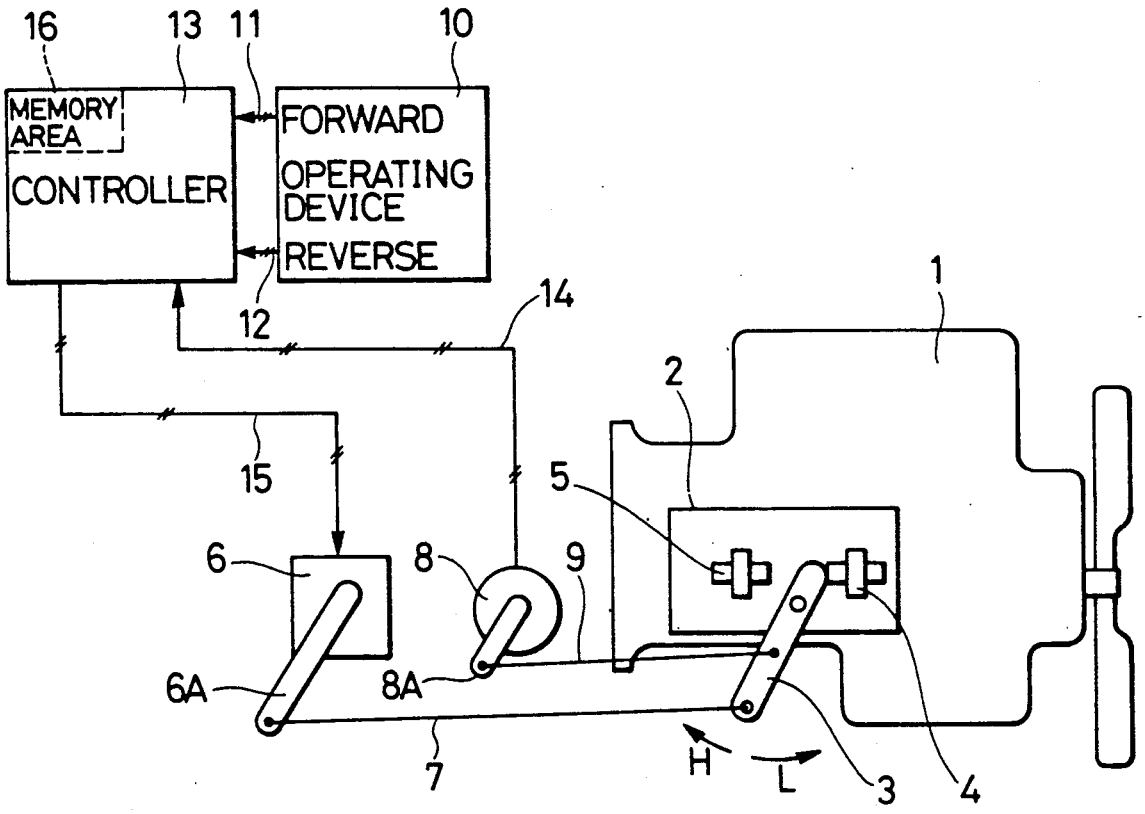
Figure 3:
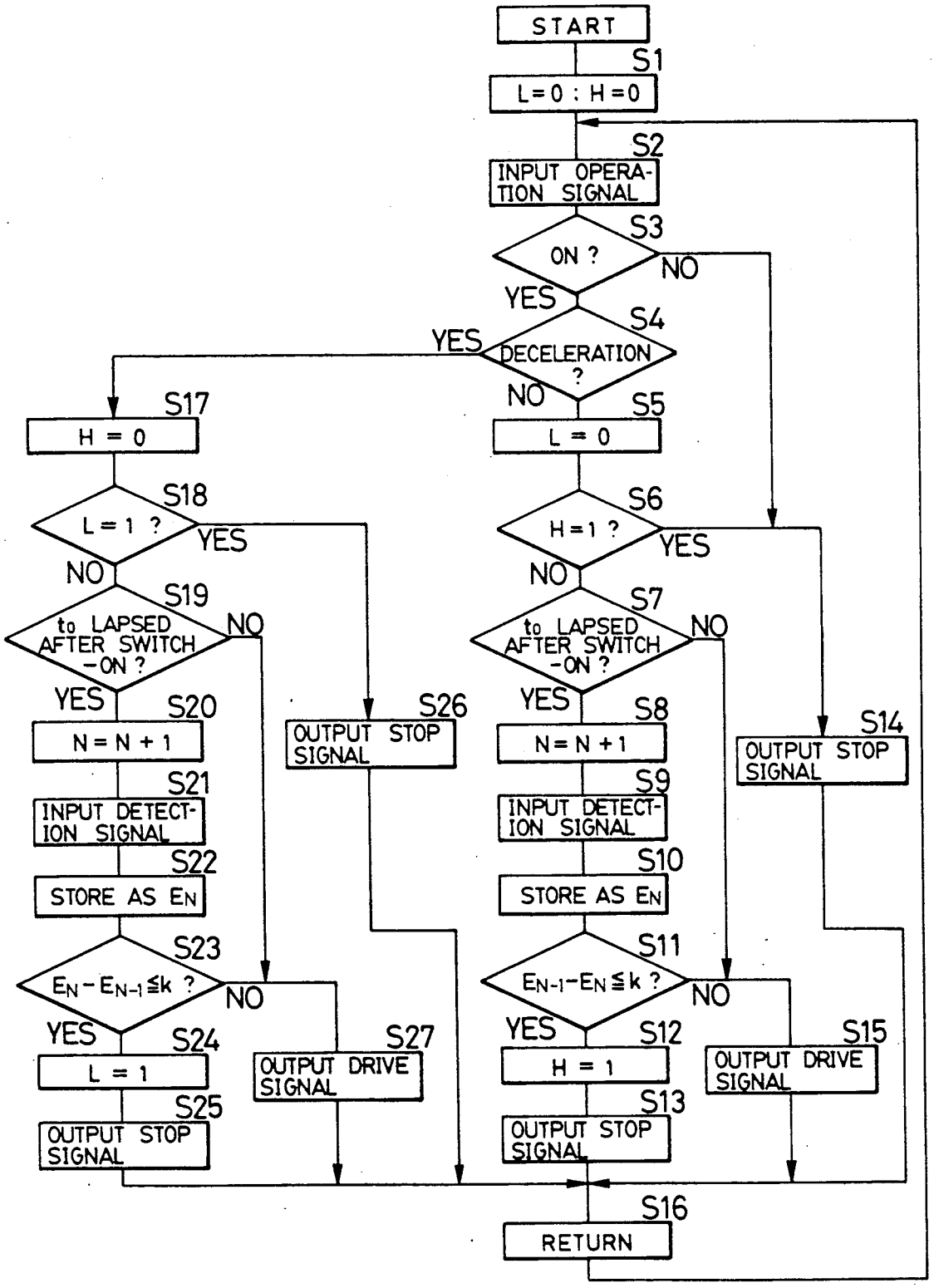

Referring to FIGS. 1 to 3, there is shown a first embodiment of the invention. In FIG. 1, indicated at 1 is a Diesel engine (hereinafter referred to simply as "engine" for brevity) which is mounted on a construction machine. The engine 1 is provided with a governor mechanism 2 with a control lever 3 to adjust the engine speed according to the degree of tilting of the control lever 3 in an accelerating direction H or in a decelerating direction L. Denoted at 4 and 5 are stoppers which limit the rotation of the control lever 3 in the accelerating and decelerating directions, respectively.

The reference numeral 6 indicates a driving device which is provided in the vicinity of the engine 1 and consists of a reversible stepping motor, brushless DC motor or the like. A lever 6A which is mounted on the output shaft of the motor 6 is connected to the control lever 3 by a link 7, so that the control lever 3 is tilted into the accelerating direction H or decelerating direction L according to the forward or reverse rotation of the drive mechanism 6. Even when a stop signal is applied to the driving device 6 to stop its rotation, the control lever 3 can be maintained at a tilted angle corresponding to an operation signal from an operating device 10, which will be described hereinafter, to hold the engine 1 in operation at constant speed.

Designated at 8 is a detector, for example, a rotational angle sensor like rotary encoder, which is located in the vicinity of the engine 1 and has a lever 8A mounted on its rotational shaft. The lever 8A is connected to the control lever 3 through a link 9 to produce a detection signal in the form of a detection voltage or digital signal corresponding to the degree of tilting of the control lever 3.

The afore-mentioned operating device 10 is provided in an operator's cabin of construction machine for setting the rotational speed of the engine 1 in the accelerating or decelerating direction. For example, as the operating device, there may be employed a rotary switch or the like which is operationally interlocked with an up-down switch or potentiometer to produce an accelerating or decelerating operation signal corresponding to the extent of manipulation of the operating device for supply through signal lines 11 and 12 to a control device 13 which will be described hereinafter. In case an up-down switch is used as the operating device, settings of acceleration and deceleration are made while the up- and down-switches are depressed, respectively.

Designated at 13 is the control device which is provided, for example, in a control unit in the operator's cabin, and constituted by a microcomputer including processing circuits composed of CPU, MPU and the like, a memory circuit composed of ROM, RAM and the like, and an I/O control circuit. The input side of the control device 13 is connected to the operating device 10 through the signal lines 11 and 12, and to the detector 8 through signal line 14, while its output side is connected to the driving device 6 through signal line 15.

In this instance, the memory circuit of the control device 13 is provided with a memory area 16 as shown in FIG. 2, and stores a program shown in FIG. 3 and executed as will be described hereinafter for controlling the drive and stop of the driving device 6.

The memory area 16 includes areas 16A to 16J. Namely, the area 16A serves to store an acceleration limit flag H indicative of a state of the control lever 3 which is judged to have reached an acceleration limit position abutting against the stopper 4; and the area 16B similarly serves to store a deceleration limit flag L indicative of a state of the control lever 3 which is judged to have reached a deceleration limit position abutting against the stopper 5. The area 16C is provided for realizing a counter N. The area 16D serves to store a current detection voltage $E_n$ read in a current program cycle, while the area 16E serves to store a previous detection voltage $E_{N-1}$ read in a previous program cycle. The area 16F serves to store a stop call voltage k, e.g. k=2V, requiring stoppage of the driving device 6 because of the control lever 3 of the governor 2 reaching its operation limit, and the area 16G similarly serves to store a stop call voltage j, e.g. j=2V. Further, the area 16H serves to store, as an acceleration limit voltage $E_H$, the voltage which is detected when the acceleration limit flag H turns to "1" in the processing of the second embodiment which will be described hereinafter, and renews its content by programmed learning every time when the engine is started. The area 16I stores a deceleration limit voltage $E_L$ similarly in the processing of the second embodiment, renewing its content by programmed learning. The area 16J stores a hysteresis time $t_o$, e.g., $t_o=1$ second, in consideration of the hysteresis of a potentiometer or the like by the time lag of producing an operation signal to be actually set up after turning on a switch of the operating device 10.

Now, reference is had to FIG. 3 for explanation of the operation of the first embodiment, which is arranged in the above-described manner.

Firstly, upon starting the processing by turning on the engine key, the control device 13 initializes the acceleration and deceleration limit flags H and L to "0" under control of the processing circuit (step S1). Nextly, the control device 13 reads in the operation signal from the operating device 10 (step S2), and a check is made at step S3 to see whether or not the up-down switch is ON. If the answer at step S3 is "NO", which means no operation signal is received at the input, control returns to step S2 through steps S14 and S16 to carry out a start surveillance.

On the other hand, the answer in step S3 is "YES", indicating that an operation signal has been received from the operating device 10, the processing proceeds to step S4 to check if the operation signal is of acceleration or deceleration. When discriminated as of an accelerating operation, the deceleration limit flag L is set to "0" at the next step S5. The deceleration limit flag L is set to "0" at step S5 at the time of an accelerating operation because under certain circumstances the flag L is set in "1" at step S24 of the deceleration processing routine.

After the processing at step S5, the control proceeds to step S6 to check whether or not the acceleration limit flag H is set to "1". If the flag H is "1", it means that the control lever 3 of the governor mechanism 2 is in an acceleration limit position abutting against the stopper 4 as will be described hereinafter, and that a further operation of the driving device 6 might damage the driving device 6 and the control lever 2. Therefore, in such a case, the control proceeds from step S6 to S14 to produce a stop signal to the driving device 6, holding the control lever 3 in the full speed position.

On the other hand, when the acceleration limit flag H is found to be "0" at step S6, the processing proceeds to step S7 to check whether or not a predetermined hysteresis time $t_o$ has lapsed after turning on the switch of the operating device 10. If "NO", control goes to step S15 to produce a drive signal. Step S7 is executed only in the initial program cycle, in consideration of the hysteresis which occurs to the potentiometer or the like as mentioned hereinbefore due to the time gap between the turning-on of the switch of the operating device 10 and the production of an operation signal to be actually set up.

If the execution of step S7 results in "YES", which means that the problem of hysteresis has been solved, control advances to step S8 to increment the counter N of the area 16C, reading in the amount of the current detection signal from the detector 8 at next step S9. Then, at step S10 a detection voltage $E_N$ corresponding to the amount of the current detection signal is stored in the area 16D. At the time of returning the program cycle, the current detection voltage $E_N$ stored in the area 16D may be shifted into the area 16E as a previous detection voltage $E_{N-1}$.

Nextly at step S11 a check is made to see whether or not the difference between the currently read-in detection voltage $E_N$ and the detection voltage $E_{N-1}$ read in the previous program cycle is smaller than a stop call voltage k. If the answer at step S11 is negative, meaning that the control lever 3 of the governor mechanism 2 is being continually tilted in the accelerating direction, the processing goes to step S15 to produce to the drive mechanism 6 a drive signal corresponding to the operation signal, further tilting the control lever 3 in the accelerating direction by the driving device 6.

When the execution of step S11 results in "YES", this means that the control lever 3 is in a full speed position (maximally tilted position) abutting against the stopper 4, and that the difference between the current detection voltage $E_N$ and the previous detection voltage $E_{N-1}$ is smaller than the stop call voltage k. Accordingly, in this case the processing proceeds to step S12 to set the acceleration limit flag H in "1", and then to step S13 to produce a stop signal to the driving device 6, holding the control lever 3 of the governor mechanism at the full speed position The foregoing operations are performed when step S4 discriminates an accelerating operation through the operating device 10. In case step S4 discriminates a decelerating operation, steps S17 to S27 are executed in a similar manner. When the execution of step S23 results in "YES", the control lever 3 is in an idling speed position (minimally tilted position) in abutting engagement with the stopper 5, and a further reduction of speed might invite an engine stall (engine stop). Therefore, in such a case control goes to step S24 to set the deceleration limit flag to "1", and then to step S25 to produce a stop signal to the driving device 6, holding the control lever 3 in the idling speed position.

Thus, according to the present invention, the difference between the detection voltages in the previous and current program cycles is compared with the stop call voltage k in the respective program cycles at regular time intervals, suspending the application to the driving device 6 of the output drive signal of the control device 13 when the acceleration limit voltage $E_H$ or deceleration limit voltage $E_L$ is reached, and holding the control lever 3 of the governor mechanism 2 in the full speed position or in the idling speed position. Accordingly, it becomes possible to prevent damage and breakage of the driving device 6 and control lever 3 without providing limit switches. Besides, stable operating conditions can be secured without interrelational preadjustments in operational or rotational amount of the operating device 10, detector 8, driving device 6, control lever 3 and the like.

Figure 4:
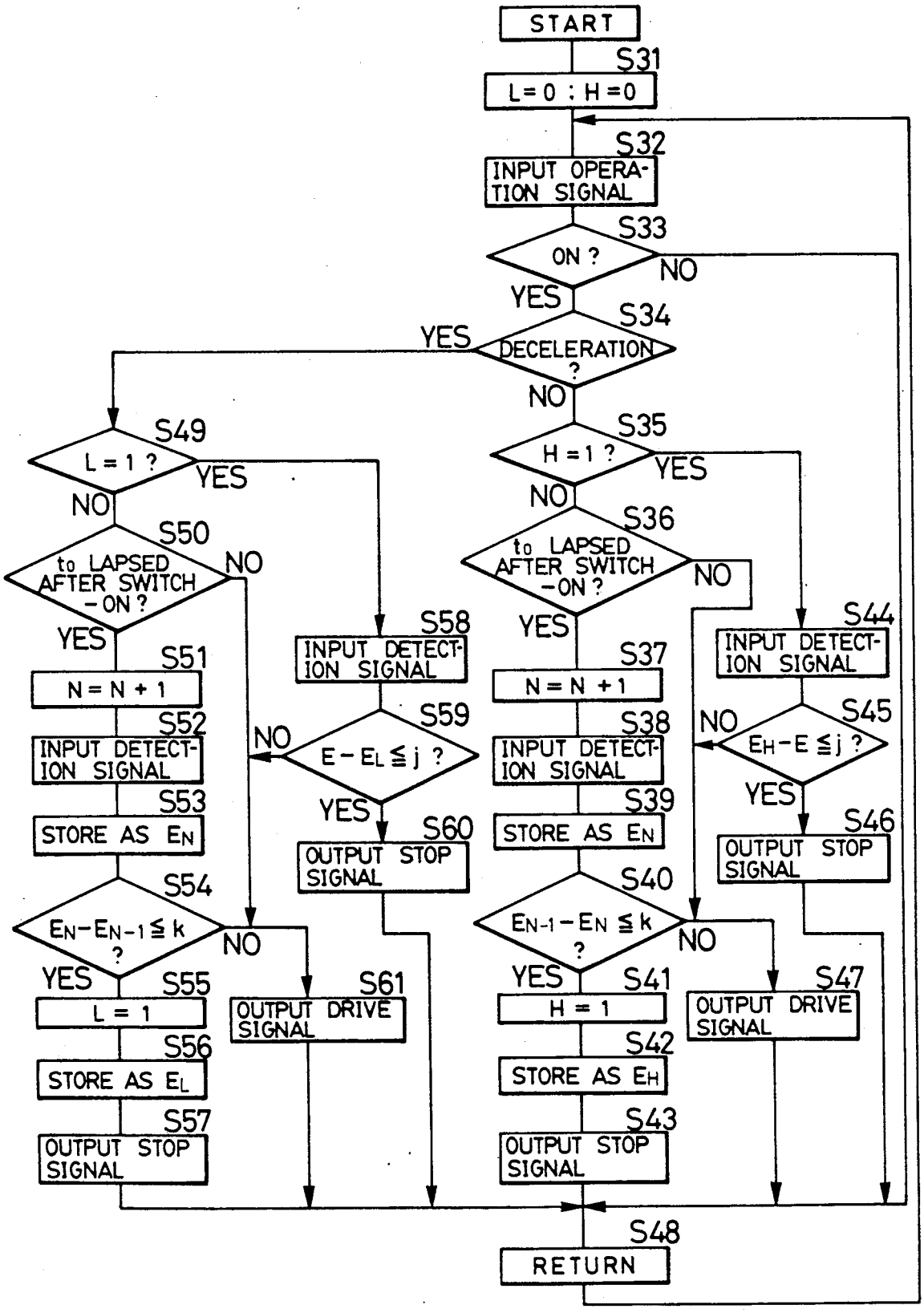
FIG. 4 is a flow chart of processing steps for the control of the driving device in another embodiment of the invention.

Referring now to FIG. 4, there is shown a flow chart in a second embodiment of the invention, which differs from the first embodiment in that steps S42, S44, S45, S56, S58 and S59 are added while steps S5 and S17 of FIG. 3 are excluded. This embodiment uses the areas 16H and 16I of FIG. 2.

Namely, a feature of this embodiment resides in that the acceleration and deceleration limit voltages $E_H$ and $E_L$ at the time point when the operation limit flag H or L turns to "1" are learned and stored in the memory area every time on an engine start, thereafter producing the drive and stop signals on the basis of the limit voltages $E_H$ and $E_L$.

In FIG. 4, after initializing the flags L and H in step S31 at the outset of processing, the operation signal from the operating device 10 is read in at steps S32 and S33. When an accelerating operation is discriminated at step S34, the processing proceeds to S35→S36→S47 in the initial program cycle alone in the same manner as in the first embodiment, and in the succeeding program cycles to S35→S36→S37→S38→S39 →S40→S47 to produce a drive signal to the driving device 6 thereby to accelerate the speed of the engine 1. When a full speed condition is discriminated at step S40 in a certain program cycle, the processing goes to step S41 to set the acceleration limit flag H to "1". This processing operation is one particular example of the first drive control means.

When the flag H is set to "1", the detection voltage E at that time point is stored in the area 16H as an acceleration limit voltage $E_H$, and a stop signal is produced to the driving device 6 at step S40 to hold the control lever 3 of the governor mechanism 2 in the full speed position, then returning to step S32 from step S48. This process is a particular example of the memory means.

Therefore, although the above-described process has no difference from the first embodiment except that the acceleration limit voltage $E_H$ is learned and stored in step S42.

After setting the flag H to "1", the answer in step S35 is always "YES", so that the processing advances to step S34→S35→S44→S45→when an accelerating operation is discriminated in step S34. At step S45, a check is made to see whether or not the difference between the current detection voltage E according to the detection signal read in at step S44 and the learned acceleration limit voltage $E_H$ is greater than the stop call voltage j. In case the execution of step S45 results in "NO", it means that the control lever 3 of the governor mechanism 2 is being continually turned in the accelerating direction, so that a drive signal corresponding to the operation signal is produced to the driving device 6 in step S47 to further tilt the control lever 3 in the accelerating direction through the driving device 6.

In case the answer at step S45 is "YES", the control lever 3 is in the full speed position abutted against the stopper 4, so that control goes to step S46 to produce a stop signal to the driving device 6, holding the full speed position.

On the other hand, when a decelerating operation is discriminated at step S34, control goes to steps S49–S61, and, when the engine is similarly found to be at the minimum idling speed in step S54, the deceleration limit flag L is set to "1" at step S55, while the deceleration limit voltage $E_L$ is stored in the area 16I as a learned value. Thereafter, from step S49 the processing goes to steps S58–S61. This process is a particular example of the second drive control means.

Thus, in this embodiment, the limit voltage $E_H$ or $E_L$ at the time of the first full speed rotation or minimum speed idling rotation after an engine start is stored as a learned value, and thereafter the drive and stop signals are produced on the basis of these limit voltages $E_H$ and $E_L$, making it possible to effect the remote control appropriately in spite of time-wise variations in characteristics and accuracy of the engine 1, driving device 6, detector 8 and so forth. The above-described learning processing may be carried out every n-number of times of engine start, or at the first engine start in a day, or upon receipt of an external command signal.

Figure 5:
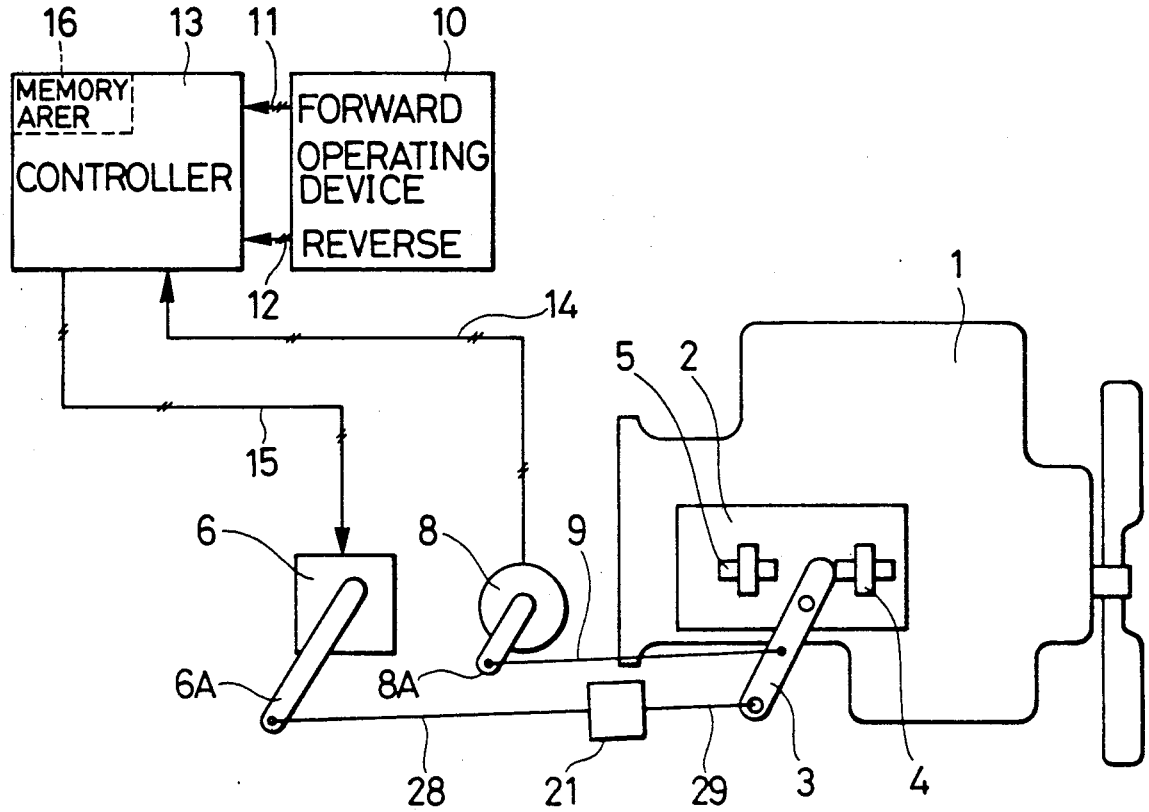
Figure 6:
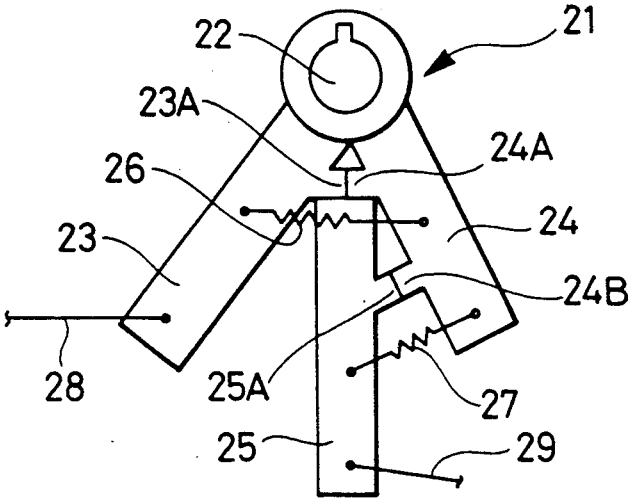

Referring to FIGS. 5 and 6, there is shown a third embodiment of the invention, which is provided with a protection device between the driving device and the governor mechanism and wherein the component parts common to the above-described first embodiment are designated by common reference numerals and their description is omitted to avoid unnecessary repetitions.

In these figures, indicated at 21 is a protection device which is provided between the control lever 3 of the governor mechanism 2 and the lever 6A of the driving device 6, the protection device 21 including a rotational shaft 22, three levers 23, 24, 25 rotatably mounted on the rotational shaft 22, a biasing spring 26 provided between the levers 23 and 24 and constantly urging projections 23A and 24A of these levers into abutting engagement with each other, and another biasing spring 27 provided between the levers 24 and 25 and constantly urging projections 24B and 25A of these levels into abutting engagement with each other. The lever 23 is connected to the lever 6A of the driving device 6 through a link 28, while the lever 25 is connected to the control lever 3 of the governor mechanism 2 through a link 29.

With this arrangement, when the driving device 6 is in normal condition, a rotational movement of the lever 6A of the driving device 6 is transmitted to the lever 23 by displacement of the link 28, and the rotational displacement of the lever 23 is transmitted to the lever 25 through the spring 26 or 27 and lever 24 and then to the control lever 3 of the governor mechanism 2. Accordingly, the levers 23, 24 and 25 of the protection device 21 are operated integrally under normal operating condition.

On the other hand, in full-speed rotation with the control lever 3 abutted against the stopper 4, even if the driving device 6 tends to rotate to an excessive degree in the accelerating direction, the lever 23 is pulled against the action of the spring 26 since the lever 25 is blocked against rotation, and the lever 23 alone is turned clockwise to permit free action of the driving device 6.

Conversely, in an engine operation with the control lever 3 abutted against the stopper 5, if the driving device 6 tends to rotate to an excessive degree in the decelerating directions the levers 23 and 24 alone are turned counterclockwise to permit free action of the driving device 6.

Thus, in this embodiment, when the driving force of the driving device 6 should exceed the preset forces of the springs 26 and 27, the driving device 6 is freed in action to prevent damages or other accidents which would be caused by overloading.

Industrial Applicability

It will be appreciated from the foregoing description that the engine remote control system of the invention is arranged to check the controlled amount of the control lever in each program cycle or on time base, stopping the operation of the driving device when the control lever is found to have reached a limit control amount.

Since there is no need for providing limit switches and a cam member for the driving operation, the system can be simplified in construction and obviates the interrelating preadjustments of the driving device, detector and operating device, in addition to the advantages such as prolonged service life and stable remote control.

What is claimed is:

1. An engine remote control system, comprising:

an engine having a governor mechanism for controlling the output rotation of the engine according to a specified control amount;

a driving device for driving said engine governor mechanism;

a detector for cyclically discerning the extent of control effected to said governor mechanism by said driving device;

an operating device for producing an operation signal for controlling the output rotation of said engine; and a control device for producing a drive signal or a stop signal to said driving device on the basis of said operation signal from said operating device and said detection signal from said detector, said control device being adapted to read in said detection signal cyclically at predetermined time intervals, compare the extent of effected control in a current cycle of surveillance with the extent of effected control in a preceding cycle to produce a stop signal to said driving device when the difference in the extent of control between the two cycles becomes smaller than a predetermined value, otherwise producing a drive signal based on said operation signal.

2. An engine remote control system, comprising:

an engine having a governor mechanism for controlling the output rotation of an engine according to a specified control amount;

a driving device for driving said engine governor mechanism;

a detector for discerning the extent of control effected to said governor mechanism by said driving device;

an operating device for producing an operation signal for controlling the output rotation of said engine; and a control device for producing a drive signal or a stop signal to said driving device on the basis of said operation signal from said operating device and said detection signal from said detector, said control device having a first drive control means adapted to produce a drive signal or a stop signal to said driving device on the basis of said operation signal from said operating device and said detection signal from said detector, read in said detection signal cyclically at predetermined time intervals, and compare the extent of effected control in a current cycle of surveillance with the extent of effected control in a preceding cycle to produce a stop signal to said driving device when the difference in the extent of control between the two cycles becomes smaller than a predetermined value, otherwise producing a drive signal based on said operation signal, a memory means with a function of learning and storing as a control limit the extent of effected control at a time point when an operation limit of said governor mechanism is discriminated by said first drive control means, and a second drive control means adapted to compare said control limit stored in said memory means with a detected amount of control from said detector in cycles succeeding the discrimination of the control limit of said governor mechanism and produce a stop signal to said drive mechanism when the difference is smaller than a predetermined value regarded as a limit of operation of said governor mechanism, otherwise producing a drive signal based on said operation signal.

3. An engine remote control system as defined in claim 1 or 2, wherein a protection device is provided between said drive and said governor mechanisms for permitting free action of said drive mechanism when the driving force to be applied to said governor mechanism from said drive mechanism exceeds a predetermined level.

* * * * *